United States Patent [19]

Eisinger

[11] 4,204,570

[45] May 27, 1980

[54] HELICAL SPACER FOR HEAT EXCHANGER TUBE BUNDLE

[75] Inventor: Frantisek L. Eisinger, Demarest, N.J.

[73] Assignee: Foster Wheeler Energy Corporation, Livingston, N.J.

[21] Appl. No.: 880,399

[22] Filed: Feb. 23, 1978

[51] Int. Cl.[2] ..... F28F 9/00

[52] U.S. Cl. ..... 165/69; 122/510; 165/162; 165/172; 248/68 R

[58] Field of Search ..... 165/69, 76, 162, 172, 165/82; 122/510; 248/68 R

[56] References Cited

U.S. PATENT DOCUMENTS

| | | | |
|---|---|---|---|
| 2,238,532 | 4/1941 | Nöthe | 248/68 R |
| 2,397,291 | 3/1946 | Robertson | 248/68 R |
| 3,070,534 | 12/1962 | Kooistra | 165/82 |
| 3,326,282 | 6/1967 | Jenssen | 165/172 |
| 3,438,434 | 4/1969 | Smith | 165/162 |

FOREIGN PATENT DOCUMENTS

| | | | |
|---|---|---|---|
| 2213126 | 9/1972 | Fed. Rep. of Germany | 165/162 |
| 2547974 | 4/1977 | Fed. Rep. of Germany | 165/172 |
| 685848 | 1/1953 | United Kingdom | 165/162 |
| 1188564 | 4/1970 | United Kingdom | 165/162 |
| 1301098 | 12/1972 | United Kingdom | 165/172 |

*Primary Examiner*—Sheldon Richter

*Attorney, Agent, or Firm*—Marvin A. Naigur; John E. Wilson; John J. Herguth, Jr.

[57] ABSTRACT

A tube spacer is provided for use in a tube bundle including a plurality of spaced apart rows of tube sections. The spacer comprises an elongated member having a contour defining a helix, is adapted to extend through the spaces defined between adjacent tube sections of the rows of tube sections and to contact the outside surfaces of the tube sections, and is adapted to be removed from the tube bundle in the direction in which it extends into the tube bundle.

14 Claims, 10 Drawing Figures

HELICAL SPACER FOR HEAT EXCHANGER TUBE BUNDLE

BACKGROUND OF THE INVENTION

This invention relates to an apparatus for spacing tubes of a heat exchanger tube bundle apart from one another and for reducing the vibration of the tubes during the operation of the heat exchanger.

Several different types of shell and tube heat exchangers are used for accomplishing indirect heat exchange between different mediums. Typical of such tube and shell heat exchangers are feedwater heaters, condensers and steam generators. In a tube and shell heat exchanger a tube bundle is disposed within a shell, and a heat exchange medium is passed through the tubes for indirect heat exchange with another heat exchange medium which is passed within the shell and over the outer surface of the tubes. In some heat exchangers the tube bundle comprises a group of straight tubes extending between an inlet header and an outlet header, with the tubes connected into tube sheets disposed at opposite ends of the shell. In other heat exchangers the bundle comprises a group of U-shaped tubes, with he tubes being secured at respective inlet and outlet ends to a single tubesheet, and the respective ends communicating with inlet and outlet headers. Regardless of the particular arrangement of the tube bundle, the tubes are axially spaced apart from one another, in order to expose the outer surface of each tube to the heat exchange medium which is passed over the tubes within the shell of the heat exchanger. The aforementioned tubesheets, as well as baffle plates and/or spacer assemblies, are used among other reasons to keep the tubes spaced apart from one another. The tubesheets, baffle plates and spacer assemblies are ordinarily installed during the fabrication of the heat exchanger.

If, after construction of the heat exchanger it is discovered that the tubesheets, baffles and spacer grids do not provide adequately for maintaining axial spacing of the tubes, it has heretofore been necessary to disassemble much of the heat exchanger, in order to relocate or install additional structural members, such as additional spacer grids, to correct such a problem. Furthermore, if after construction of the heat exchanger it is discovered that vibration of the tubes is occurring, it has heretofore been necessary to disassemble much of the heat exchanger, in order to install additional members, such as additional spacers which would serve to reduce or eliminate such vibration.

Known types of spacers, which have either been initially installed or retrofit, engage the tubes of the tube bundle substantially completely around the periphery of each tube with which it will come in contact and thereby will interfere with the flow of heat exchange medium along the outside surface of the tube in the direction along the length of each tube. Additionally, the known types of spacers, because they engage the tubes substantially completely around the periphery of the tubes, prevent the heat exchange medium flowing over the outside surface of the tubes from contacting that portion of the outer tube surface with which they come in contact.

The instant invention provides a helical spacer which can be installed either during the initial fabrication of a heat exchanger, or can be retrofit into an existing heat exchanger requiring substantially less disassembly of the heat exchanger. Additionally, the spacer of the instant invention allows for improved flow of heat exchange medium over the outer surface of the tubes of the tube bundle by reducing the area of contact between the tubes and the spacers, the effect of which is to reduce interference by the spacer with the flow of fluid in a direction along the length of the tube, and to make it possible for heat exchange medium to pass over more of the outer surface of the tubes than was possible with previously known spacers.

SUMMARY OF THE INVENTION

A tube spacer is provided for use in a tube bundle made up of a plurality of spaced apart rows of tube sections. The spacer comprises an elongated member having a contour defining a helix that is adapted to extend through spaces defined between adjacent tube sections of the rows of tubes and to contact the outside surfaces of the tube sections. The spacer is adapted to be removed from the tube bundle in the direction in which it extends into the tube bundle.

BRIEF DESCRIPTION OF THE DRAWINGS

The above brief description, as well as further objects, features and advantages of the present invention, will be more fully appreciated by reference to the following detailed description of the presently preferred but nonetheless illustrative embodiments in accordance with the present invention when taken in connection with the accompanying drawings, wherein.

DESCRIPTION OF THE PREFERRED EMBODIMENT

Figure 1:
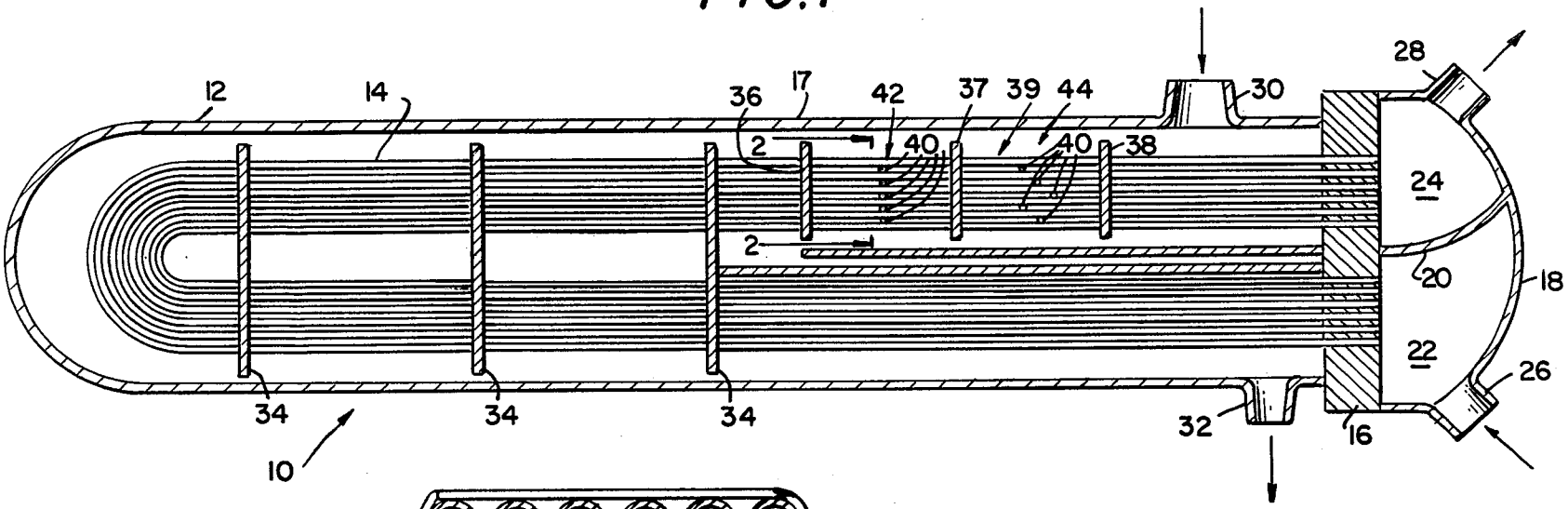
FIG. 1 is an elevational schematic view of a heat exchanger incorporating the instant invention.

Referring to FIG. 1 of the drawings, a heat exchanger incorporating the instant invention is indicated by reference numeral 10. The heat exchanger 10 includes a shell 12 within which a bundle of U-shaped tubes 14 is disposed. The tubes 14 are connected at opposite ends into openings formed in tubesheet 16. The shell 12 is welded to tubesheet 16, and together with tubesheet 16 defines a chamber 17 through which a first heat exchange medium can be passed. It is to be understood that various heat exchange media, including steam, can be used as a heat exchange medium, and the instant invention is not limited to the use of steam. A hemispherical header 18 is rigidly attached, such as by welding, to tubesheet 16. A partition 20 is connected between the tubesheet 16 and inside wall of header 18, thereby defining together with the surfaces of the tubesheet and the header, two chambers 22, 24 in flow communication with the ends of U-tubes 14. An inlet opening 26 is formed in the header 18, and allows for the introduction of a second heat exchange medium, such as water, into chamber 22. In a similar manner, an outlet opening 28 is formed in header 18 and allows for removal of the second heat exchange medium from chamber 24.

An opening 30 is formed in the top of shell 12, and allows for the introduction of the first heat exchange medium into the chamber 17. An outlet 32 is formed in the shell 12 and allows for removal of the first heat exchange medium from chamber 17. It is to be understood that while the above description refers to openings as "inlets" or "outlets", these elements could serve as either inlets or outlets depending upon the direction of the flow of heat exchange medium.

A series of baffle plates 34 extend transversely across the chamber 17, generally parallel to the tubesheet 16. The baffle plates are formed with openings for receiving the tubes 14 of the tube bundle. The tubes 14 are of smaller outside diameter than the diameter of a respective opening, in order to allow for movement of the tube 14, which could result from thermal expansion. The baffle plates serve to support tubes 14, maintain axial alignment of the tubes 14, and also to direct the flow of the heat exchange medium over the outside surfaces of the tubes 14. Additional baffle plates 36, 37, 38 extend only partially across the chamber 17, and receive only some of the tube sections of the tubes 14. These partial baffle plates are used in the desuperheating zone 39 of the heat exchanger 10 and serve to direct the flow of heat exchange medium from side to side along the length of the heat exchanger 10 in the desuperheating zone 39. The plates 36, 37, 38 also provide support for the tubes 14, and maintain axial alignment of the tubes 14. It is to be understood that conventional tube spacers could also be included in a heat exchanger of the type shown, although none are illustrated.

Tube spacers 40 of the instant invention are shown in FIG. 1 as being arranged into a grid 42 disposed between baffle plates 36, 37 with the spacers 40 being aligned in a direction generally perpendicular to the longitudinal axes of tubes 14. It is to be understood that the spacers need not be aligned in this manner, and can be staggered for example in the manner of the spacers forming grid 44 disposed between baffle plates 37, 38. By staggering the tube spacers in this latter manner, less interference with the flow of the first heat exchange medium will be incurred along the lengths of the tubes 14. Furthermore, even though the spacers 40 are shown as extending perpendicular to the longitudinal axes of tube 14, running substantially laterally across the heat exchanger, the spacers 40 need not be perpendicular. It is contemplated that the spacers 40 can extend at an angle other than 90 degrees to the axes of the tubes 14, as long as the spacers extend across a plurality of tube sections. It is to be understood that in some heat exchangers a single tube may be shaped in such a manner that it can pass through a particular plane more than once. This is true of the U-shaped tubes 14 of the heat exchanger 10 shown in FIG. 1. The two legs of a particular tube intersect the plane through which a baffle plate 34 extends at different elevations. Therefore, a spacer passed downwardly through the tube bundle, in the vicinity of baffle plate 34, for example, may contact the same tube 14 at more than one location. The spacer 40, when so used, would contact different sections of the same tube.

Figure 2:
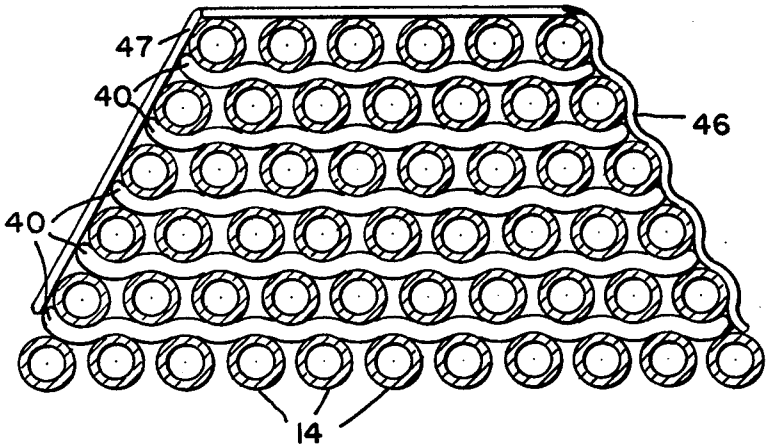
FIG. 2 is a sectional view taken along line 2—2 of FIG. 1, showing a grid of spacers of the instant invention adapted for use between staggered rows of tubes making up the tube bundle of the heat exchanger.

As better shown in FIG. 2, each tube spacer 40 has a helical contour and extends across the tube bundle, coming in contact with a plurality of tubes 14 across the outer surfaces of the tubes 14. Because the tube spacer 40 is helical in shape, it can be "screwed" into an existing tube bundle from outside of the bundle. The spacer 40 could also be installed in a conventional manner before the tubes of the bundle are fixed in place. Regardless of the manner in which the spacer 40 is located in the tube bundle, it can be removed by screwing it, or twisting it, which allows for its removal in the direction of its extension into the bundle, and therefore eliminates the need to disassemble much of the heat exchanger 10.

The helix can be formed by twisting the bar around a mandrel, or by simply twisting a plurality of parallel bars about their longitudinal axes. The relative ease of manufacture of the instant invention offers a distinct advantage over conventional tube spacers.

Figure 3:
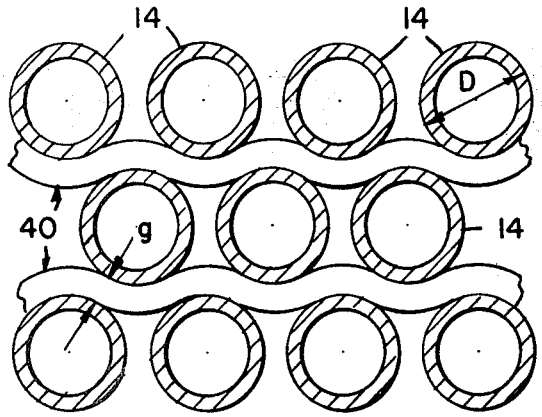
FIG. 3 is an enlarged fragmentary view of a portion of the tube bundle shown in FIG. 2 with the spacers of the instant invention extending laterally of the tube bundle.
Figure 4:
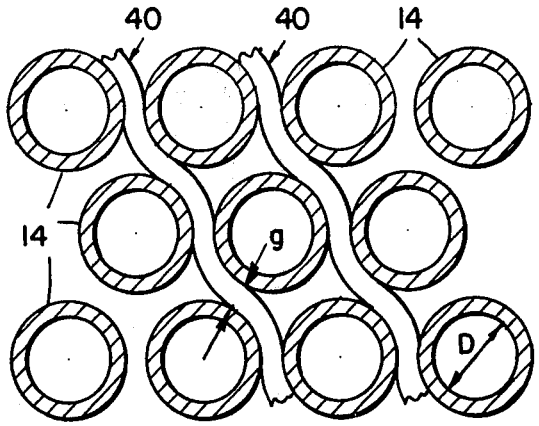
FIG. 4 is an enlarged fragmentary view similar to that of FIG. 3, but showing the spacers inserted at an angle to horizontal.
Figure 5:
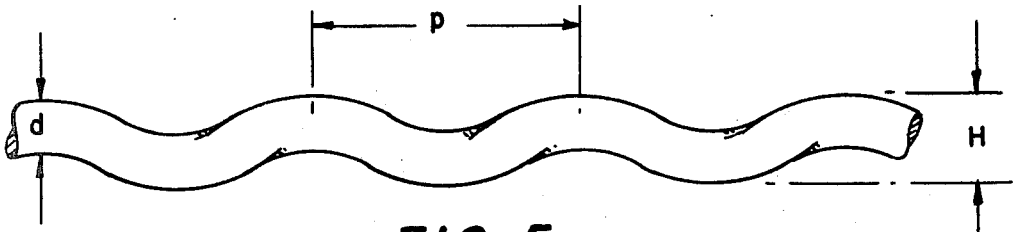
FIG. 5 is an enlarged fragmentary view of the spacer of the type shown in FIGS. 3 and 4.

The geometry of the spacer helix is dependent upon the geometry of the tube bundle and the direction of insertion. The tubes 14 in FIG. 2 are staggered, that is, the longitudinal axes of tubes of every other horizontal row of tubes, are aligned in the vertical direction. In FIG. 3 there is shown a fragmentary view of a section of the tube bundle of FIG. 2 with the spacers 40 extending in a direction substantially laterally across the tube bundle. The longitudinal axis of the spacer 40 extends generally parallel to the laterally extending rows of tubes 14, passing through the spaces g between adjacent tube sections of different rows of tubes. The spacer 40 contacts respective outside surfaces of tubes 14 defining the spaces g through which the spacer 40 passes. In FIG. 4 a spacer 40 is shown having been inserted into the same tube bundle at an angle to horizontal. The geometry of the spacer 40 in FIG. 4 may be different from that of the spacer 40 in FIG. 3. A general description of spacer 40 for use in tube bundle arrangements including staggered rows of tubes between which there is clearance is shown in FIG. 5. For such a spacer 40, the diameter, d of the bar formed into a helix can be less than or equal to the space g between adjacent tubes of different rows. The pitch of the helix, designated as p in FIG. 5, represents the distance between corresponding points of consecutive lands of the helix measured parallel to the longitudinal axis of the spacer 40, and is dependent upon the axial spacing of tubes 14 arranged in rows extending parallel to the direction of extension of the spacer 40 and the angle which the spacer makes with the longitudinal axes of these tubes. The outside diameter of the helix, H, is dependent on the outside diameter d of the bar formed into spacer 40, the outside diameter D of the tubes 14, and the spacing of the tubes 14.

Figure 6:
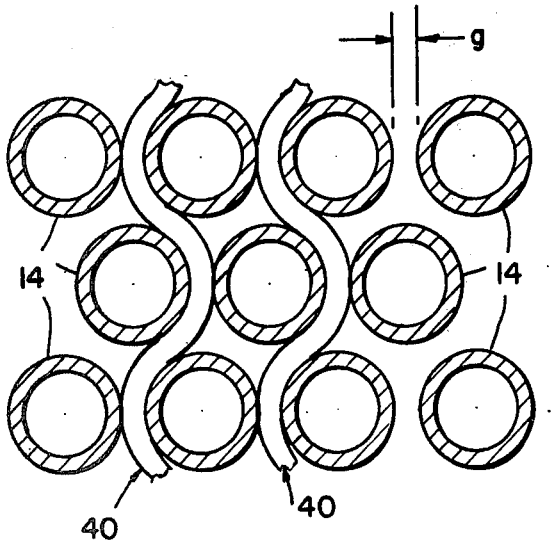
FIG. 6 is an enlarged fragmentary view similar to that of FIGS. 3 and 4, but showing spacers extending perpendicular to the laterally extending rows of tubes.

In FIG. 6 there is shown another arrangement of tube spacers 40 extending across tubes 14 of the tube bundle of FIG. 1. In this arrangement the spacer 40 was inserted vertically through the tube bundle. In a vertical direction the rows of tubes extending parallel to the direction of insertion of the spacer do not have clearance therebetween; upon looking vertically through the tube bundle, one would see only tube sections of two laterally extending rows of tubes. It can be appreciated that the spacer 40 will contact some tubes 14 at only one location when there is not clearance between rows of tubes 14, and will contact other tubes 14 at a plurality of locations.

Figure 7:
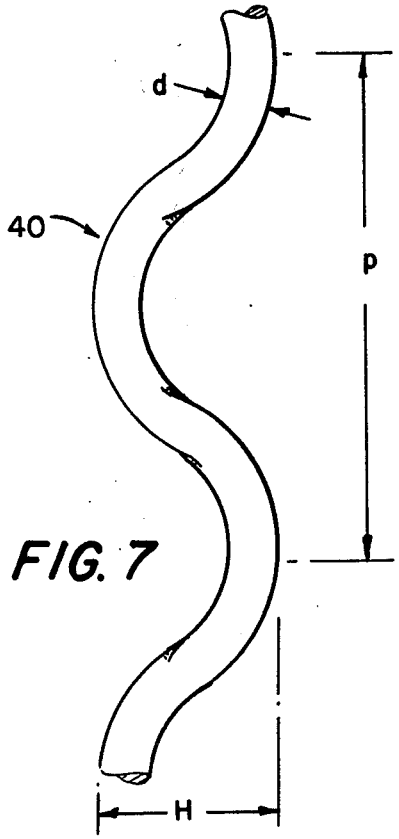
FIG. 7 is an enlarged fragmentary view of a spacer of the type shown in FIG. 6.

The geometry of the spacer 40 to be used in this arrangement is shown in FIG. 7. As was true with the spacer of FIG. 5, the pitch p of the spacer 40 of FIG. 7 is a function of the axial spacing of tubes 14 of a row of tubes extending parallel to the direction of extension of the spacer 40 and the angle which the spacer makes with the longitudinal axis of these tubes. The outside diameter of the helix H is a function of the outside diameter d of the bar formed into the helical spacer 40, the outside diameter D of the tubes 14, and the spacing of tubes 14. The outside diameter d of the bar formed into a helix, in this embodiment, is less than the space between adjacent tubes of different rows of tubes extending parallel to the direction of extension of spacer 40. It should be noted that the tubes 14 may not be equally spaced from each other in all directions and therefore the smallest space g between adjacent tubes through which spacer 40 passes, will determine the upper limit for the dimension d.

Although not shown, it is to be understood that when spacer 40 extends at an angle other than 90 degrees to the longitudinal axes of tubes 14, the geometry of the spacers will change. For example, if spacers 40 were to penetrate the tube bundle on one side of heat exchanger 10 adjacent baffle plate 38, extend at an angle to the longitudinal axes of tubes 14 as they pass thereacross, and protrude from the opposite side of heat exchanger 10 adjacent baffle plate 37, the pitch p of such spacers 40 would be greater than the pitch of the spacers 40 shown in FIG. 1 extending across the tubes 14 perpendicular to the longitudinal axes of tubes 14.

Figure 8:
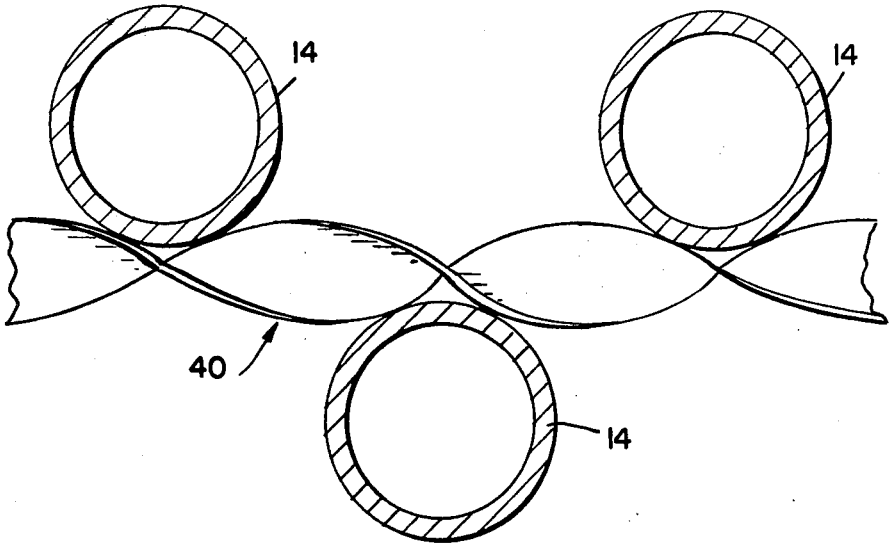
FIG. 8 is an enlarged fragmentary view similar to FIG. 3, but illustrating another embodiment of the instant invention wherein the spacer comprises a twisted flat metal strip.

In FIG. 8, there is shown another embodiment of the spacer 40 in which the spacer 40 comprises a flat bar, twisted such that its edges define a pair of opposed helices.

Figure 9:
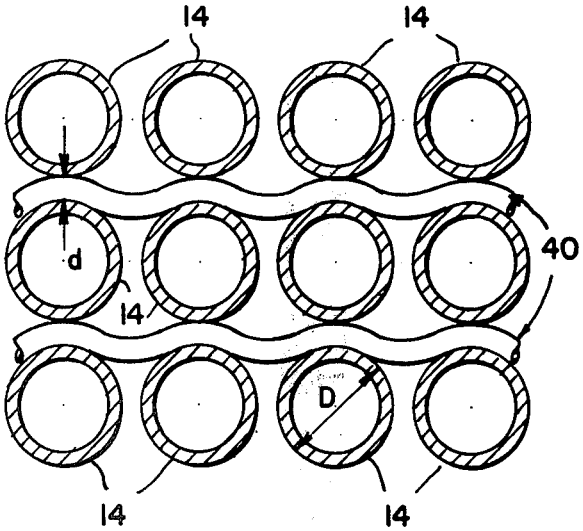
FIG. 9 is an enlarged fragmentary view of a tube bundle in which the tubes are arranged into rows that are aligned laterally and vertically, and an associated spacer of the instant invention.

In FIG. 9, a fragmentary view similar to those of FIGS. 3 and 4 is shown, in which the tubes 14 forming the tube bundle are aligned in the lateral direction, and in the vertical direction.

Figure 10:
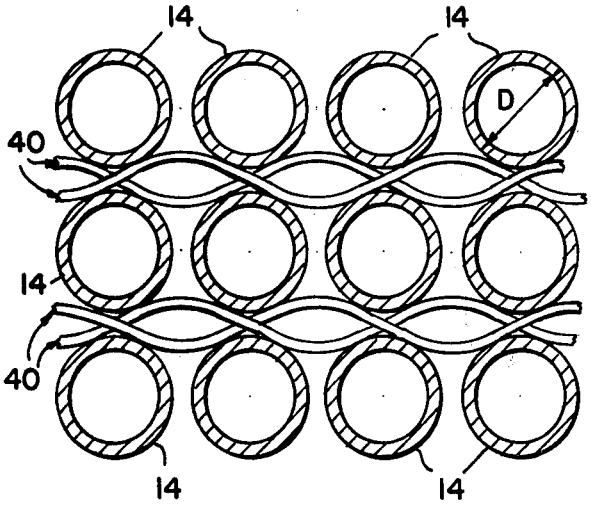
FIG. 10 is an enlarged fragmentary view similar to that of FIG. 1 but illustrating another embodiment of the instant invention wherein a double spacer is adapted for use between axially aligned tubes making up the tube bundle.

In FIG. 10 there is shown a fragmentary view of a portion of a tube bundle in which the tubes are aligned in the lateral and vertical directions similar to those of FIG. 9. The spacer arrangement of this embodiment comprises a pair of helical spacers 40, of opposite twists. Each of the spacers 40 of the spacer assembly of FIG. 10 have the same helix pitch, bar biameter and helix outside diameter, but they have opposite twist directions, one being a clockwise twist, the other being counterclockwise. It should be understood that more than two helical members could be used, with the pitch of each member being dependent on the tube dimensions, the direction of insertion and the number of helical members used. Furthermore, each of the spacers 40 could have the same twist direction, if desired.

Whereas the descriptions of the various embodiments of spacer 40 refer to a rigid "bar" being formed into a helix, it should be noted that the helix can be formed of a hollow member such as a tube, and need not be a solid member. It should also be understood that the "bar" need not have a circular cross section, but can have various cross sections, as long as the geometry of the helix allows for insertion and/or removal from the tube bundle by screwing or twisting the spacer into and/or out of the tube array.

The contact geometry of a spacer 40 and associated tubes 14, can also vary depending upon the spacer geometry. In the arrangement shown in FIGS. 2, 3, 4 and 8, each spacer 40 contacts a given tube at two locations, whereas in the arrangement of FIGS. 6 and 9, the spacers 40 contact some tubes at one location, and other tubes at two locations. In FIG. 10 the spacers 40 contact each tube at one location.

Because the spacers 40 are not in continuous contact with the tubes 14 which they engage, the flow of the first heat exchange medium over the outside surface of the tubes is enhanced, since relatively little outside surface area of the tubes is not exposed to the heat exchange medium. Furthermore, the flow along the length of the tubes 14 is improved relative to known spacer arrangements because the spacer 40 creates relatively less resistance to flow along the length of tubes 14. It is to be understood that by varying the geometry and dimensions of a spacer 40 one can obtain spacers having different resistance to fluid flow. Additionally, when a plurality of spacers are arranged into staggered rows to form a grid, such as grid 44 of FIG. 1, even less interference with the flow of heat exchange medium over the outside surface of the tubes 14 can be encountered.

As previously mentioned, spacers serve not only to maintain the tube alignment, but also act to lessen or eliminate vibration of the tubes 14. By varying the dimensions of the spacer 40 and/or the contact geometry of the spacer and tube sections, the damping capability of the spacer can be varied in accordance with the particular requirements of a particular heat exchanger.

Returning fo FIG. 2, adjacent the ends of spacers 40 extending outwardly of the tube bundle, a connecting rod 46 is welded to the aligned row of spacers 40 disposed between baffle plates 36 and 37. Although not shown, it is to be understood that a plurality of connecting rods 46 can be connected to respective rows of the staggered spacers 40 disposed between baffle plates 37, 38, shown in FIG. 1. When the plurality of connecting rods are used, the connecting rods can be interconnected to one another so as to prevent movement of the individual rows of spacers. In FIG. 2 the connecting rods 46 are shown as being curved to match the contour of the tube bundle outside surface. It is to be understood that the connecting rods can be straight members, such as those designated 47, or even could be of a different shape depending upon the shape of the tube bundle. For example, if the tube bundle had a generally circular cross section, arcuate connecting rods could be used.

A latitude of modification, change and substitution is intended in the foregoing disclosure, and in some instances, some features of the invention will be employed wthout a corresponding use of other features. Accordingly, it is appropriate that the appended claims be construed broadly and in a manner consistent with the scope of the invention herein.

What is claimed is:

1. A tube spacer for use in a tube bundle including a plurality of spaced apart rows of parallel tube sections comprising an elongated member having a contour defining a helix, said member being adapted to extend at an angle to the longitudinal axes of said tube sections through spaces defined between adjacent tube sections of said rows and to contact the outside surfaces of some of said tube sections, said helix having a pitch proportional to the distance between longitudinal axes of adjacent tube sections contacted by said spacer, said proportion being a function of said angle at which said spacer extends relative to said longitudinal axes of said tube sections, said spacer being adapted to be removed from said tube bundle in the direction in which said spacer extends into said tube bundle.

2. A tube spacer according to claim 1 wherein said member comprises a bar having a circular cross section, and wherein said helix has a pitch equal to the distance between longitudinal axes of adjacent tube sections of one of said rows of tube sections, said angle being equal to 90°.

3. A tube spacer according to claim 1 wherein said elongated member comprises a flat bar twisted about a longitudinal axis along the length thereof.

4. A tube spacer according to claim 1 wherein said elongated member comprises a tubular member.

5. In a heat exchanger including a tube bundle made up of a plurality of spaced apart rows of parallel tube sections, the improvement comprising a tube spacer including an elongated member having a contour defining a helix, said member extending at an angle to the longitudinal axes of said tube sections through spaces defined between adjacent tube sections of said rows and contacting the outside surfaces of some of said tube sections, said helix having a pitch proportional to the distance between longitudinal axes of adjacent tube sections contacted by said spacer, said proportion being a function of said angle at which said spacer extends relative to said longitudinal axes of said tube sections, said tube spacer being adapted to be removed from said tube bundle in the direction in which said spacer extends into said tube bundle.

6. The improvement of claim 5 further comprising a plurality of said members extending parallel to each other across said tube bundle, thereby defining a grid of said spacers, and means for connecting said spacers to each other.

7. The improvement of claim 6 wherein said spacers comprise respective bars having circular cross sections, each of said helices having a pitch equal to the distances between longitudinal axes of adjacent tube sections of one of said rows of tube sections, said distance being measured along the length of said respective spacers, said angle being equal to 90°.

8. The improvement of claim 6 wherein said spacers comprise respective tubular members.

9. The improvement of claim 6 further comprising an additional elongated member having a contour defining a helix, said additional member being coaxial with said first named elongated member, said additional member having a contour defining a helix of an opposite twist from the twist of said helix defined by the contour of said first-named elongated member.

10. The improvement of claim 6 further comprising an additional elongated member having a contour defining a helix, said additional member being coaxial with said first-named elongated member.

11. The improvement of claim 6 wherein said spacers are aligned in a plane extending perpendicular to the longitudinal axes of said tube sections.

12. The improvement of claim 6 wherein said spacers are staggered across said tube bundle such that said spacers are misaligned in a direction extending perpendicular to the longitudinal axes of said tube sections.

13. The improvement of claim 11 wherein said connecting means comprises a plurality of connector rods rigidly united to said spacers, one of said rods being united to each of said spacers adjacent respective ends of said spacers, another of said rods being united to each of said spacers adjacent respective other ends of said spacers.

14. The improvement of claim 12 wherein said means for connecting said staggered spacers comprises a first plurality of connecting rods arranged in rows adjacent respective first ends of said spacers, each of said first rods being united to respective first ends of a respective plurality of said spacers, a second plurality of connecting rods arranged in rows adjacent respective second ends of said spacers, each of said second rods being united to a respective end of a respective plurality of said spacers, means for connecting said first rods to each other, and means for connecting said second rods to each other.

* * * * *